US006251307B1

(12) United States Patent
LeCours et al.

(10) Patent No.: US 6,251,307 B1
(45) Date of Patent: Jun. 26, 2001

(54) METAL PASSIVATION FOR ANODE GRADE PETROLEUM COKE

(75) Inventors: Steven Matthew LeCours, Boothwyn, PA (US); Arthur Warren Chester, Cherry Hill; Gary Lester Smith, Lawrenceville, both of NJ (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/437,863

(22) Filed: Nov. 10, 1999

Related U.S. Application Data

(62) Division of application No. 09/135,226, filed on Aug. 17, 1998, now Pat. No. 6,024,863.

(51) Int. Cl.[7] ..... H01B 1/04; C25B 11/12

(52) U.S. Cl. ..... 252/503; 208/22; 252/508; 252/507; 204/294

(58) Field of Search ..... 208/22, 131; 252/503, 252/507, 508; 204/294; 164/105

(56) References Cited

U.S. PATENT DOCUMENTS

| | | | | |
|---|---|---|---|---|
| 3,284,373 | * | 11/1966 | Metrailer | 252/506 |
| 3,442,787 | * | 5/1969 | Landrum et al. | 204/294 |
| 4,140,623 | * | 2/1979 | Sooter et al. | 208/131 |
| 4,298,396 | * | 11/1981 | Limonchik et al. | 106/284.1 |
| 4,308,113 | * | 12/1981 | Das | 205/375 |
| 4,341,751 | * | 7/1982 | Kiikka et al. | 423/461 |
| 4,427,540 | * | 1/1984 | Hsu et al. | 208/131 |
| 4,469,585 | * | 9/1984 | Cukier | 208/39 |
| 4,713,168 | * | 12/1987 | Newman | 208/131 |

* cited by examiner

*Primary Examiner*—Walter D. Griffin
(74) *Attorney, Agent, or Firm*—Paul E. Purwin

(57) ABSTRACT

The present invention relates to the use of petroleum coke for the manufacture of carbonaceous anodes for the aluminum smelting industry. The inclusion of Group 4 and/or Group 13 metal compounds as additives to the petroleum coker feedstock diminish the oxidizing tendencies of the metal impurities inherent in the petroleum coke.

6 Claims, No Drawings

METAL PASSIVATION FOR ANODE GRADE PETROLEUM COKE

This application is a division of application U.S. Ser. No. 09/135,226, filed Aug. 17, 1998, now U.S. Pat. No. 6,024, 863.

FIELD OF THE INVENTION

The present invention generally relates to the use of petroleum coke for the manufacture of carbonaceous anodes for the aluminum smelting industry. More specifically, the present invention relates to the inclusion of Group 4 and/or Group 13 metal compounds as additives to the petroleum coker feedstock to diminish the oxidizing tendencies of metal impurities inherent in petroleum coke.

BACKGROUND OF THE INVENTION

Petroleum coke is the residue resulting from the thermal decomposition or pyrolysis of high boiling hydrocarbons, e.g. residual hydrocarbons with initial boiling points of 480-C or higher. High boiling virgin petroleum residues are typical feedstocks for the production of anode grade coke, the process often being carried out as an integral part of the overall petroleum refinery operation. Petroleum coke is manufactured by methods well known in the art, a major source being the delayed coking process (Bacha, J. D.; Newman, J. W.; White, J. L., eds., *Delayed-Coking Process Update*, PETROLEUM- DERIVED CARBONS, 1986, at 155). Other conventional coking methods known in the art include fluid coking and flexicoking.

Petroleum coke suitable for anode manufacturing is calcined in a rotary kiln at temperatures between 1200-C and 1400-C which results in the removal of excess water and volatile matter and densifies the carbon matter. The calcined coke is usually quenched with water and then formed into anodes for the production of aluminum.

Aluminum is produced by the electrolysis of alumina dissolved in a cryolite-based molten electrolyte. The electrolytic cell, known as the Hall-Heroult cell, is typically a shallow vessel, with a carbon floor forming the cathode, the side walls comprising a rammed coal-pitch or coke-pitch mixture, and the anode consisting of a carbonaceous block suspended in the molten cryolite bath.

The anode is typically formed from a pitch-calcined petroleum coke blend, prebaked to form a monolithic block of amorphous carbon. The cathode is conventionally formed from a prebaked blend of pitch and calcined anthracite or coke, with cast-in-place iron over steel bar electrical conductors in grooves in the bottom of the cathode. A large electric current is passed through the molten bath between these two sets of electrodes and breaks down the dissolved alumina into aluminum and ionic oxygen. The molten aluminum collects at the bottom of the cell and is siphoned off after a sufficient amount accumulates. The oxygen reacts with the carbon at the anode to form carbon dioxide gas. The carbon anodes are replaced after the oxygen substantially consumes them.

In principle, when alumina is reduced to aluminum metal by the Hall-Heroult process, 0.33 pounds of carbon (coke) should be consumed for each pound of aluminum metal produced. In practice, however, more than 0.33 pounds of carbon are consumed per pound of aluminum produced. Although there are several different factors which contribute to these excess carbon losses, one of the most important factors is carbon airburn, i.e. the reaction of ambient oxygen at the exposed top surface of the anode:

$$O_2+C \rightarrow CO_2$$

Since the estimated capital loss to the aluminum industry due solely to excess carbon usage is quite significant, a modest reduction in the air reactivity of the anode can have a substantial impact in cost savings for the aluminum industry.

One of the major requirements of petroleum coke used in the production of carbon anodes is low metallic impurities. As increased usage of lower grade crude oils occurs, the availability of quality feedstocks for anode grade coke production has been diminishing. Increases in the metallic impurities content of petroleum coke produced from such crude oils can thus be expected because the impurities concentrate in the petroleum coke during coking operations.

High levels of metallic impurities adversely affect anode performance because the metals catalyze oxidation of the anode surface exposed to the atmosphere during high temperature cell operation. This results in airburning that adversely affects anode life. The oxidizing metal impurities found in petroleum coke often include, but are not limited to vanadium, sodium, nickel, calcium, and iron. The oxidation of petroleum coke by reaction with air at high temperature may be measured in the laboratory by procedures known in the art as tests for air reactivity (see Hume, S. M.; Fischer, W. K.; Perruchoud, R. C.; Welch, B. J., *A Model for Petroleum Coke Reactivity*, LIGHT METALS, 1993, at 525).

The use of magnesium-based materials to passivate metal impurities in petroleum coke has been described in U.S. Pat. No. 4,427,540. However, other useful materials that can passivate the metal impurities in petroleum coke are needed. Some aluminum producers attempt to inhibit carbon airburning by protecting the exposed anode surface by coating it with alumina or other compounds or burying it with alumina after positioning the anode in the cell. This method is not fully successful. Other methods involve surface treatment of calcined petroleum coke with a coating to reduce carbon airburning of the anode formed from the coke (U.S. Pat. No. 5,628,878). These methods, however, do not alter the intrinsic oxidation properties of the coke, and once the surface coating is lost, the exposed carbon is left without protection and the anode resumes airburning rates typical of its contaminant metal content. Thus, a need exists in the field of manufacturing anode grade coke to develop new processes for manufacturing the coke in a state where the metal contaminants are passivated.

SUMMARY OF THE INVENTION

The present invention provides a method for producing petroleum coke suitable for the manufacture of carbon anodes used for the production of aluminum. According to the methods of the present invention, a hydrocarbon feedstock ("coker feedstock") is coked in the presence of inorganic and/or organometallic compounds of the Group 4 and/or Group 13 metals in amounts sufficient to passivate the oxidizing tendencies of the metal impurities inherent in the petroleum coke.

The invention also relates to the petroleum coke composition produced from the methods of the present invention as well as the carbon anodes formed from the resulting coke. As a result of coking the feedstock in the presence of the metal additives, the methods of the present invention do not merely provide a surface treatment of the coke or the resulting anode made therefrom. Rather, the methods of the present invention result in a coke product having the metal additives distributed generally homogeneously throughout the coke product, and, thus, provide the anode with greater protection from carbon consumption caused by oxidation.

DETAILED DESCRIPTION OF THE INVENTION

The present invention provides a method for producing petroleum coke suitable for use in the manufacture of carbon anodes for aluminum production from a petroleum feedstock ("coker feedstock") containing metal impurities. The methods of the present invention include adding inorganic and/or organometallic compounds of Group 4 and/or Group 13 to the coker feedstock in amounts sufficient to passivate the oxidizing tendencies of the metal impurities inherent in the petroleum coke. The passivating metal compounds are added into the coker feedstock prior to the completion of the coking process. The term "passivate" as used herein describes the ability to reduce the oxidizing tendencies of the metal impurities in the coke or anode.

The invention also relates to the petroleum coke composition produced from the methods of the present invention as well as the carbon anodes formed from the resulting coke. The carbon anodes exhibit improved resistance to oxidation usually caused by the catalytic effects of the metal impurities present in the coke.

The coker feedstock that can be used as the feedstock to the coking process in accordance with the present invention is any such feedstock known in the industry for use in a coking process. Generally, such feedstocks can be described as atmospheric or vacuum residues with initial boiling points in the range of 340 and 480-C respectively.

The coker feedstock generally has various impurity metals including vanadium and nickel which are of primary significance. These metal impurities can be present in various concentrations. Typically, vanadium is present in an amount usually between 1 and 600 ppm, and more typically between 100 and 500 ppm. Nickel is present in an amount greater than about 1 ppm, usually between 1 and 500 ppm, and more typically between 10 and 230 ppm. Other metals such as sodium, calcium, and iron may also be present to cause deleterious effects in the anode.

The Group 4 and/or Group 13 metal compounds that can be added to the coker feedstock prior to the completion of the coking process include inorganic compounds, organometallic compounds, or mixtures thereof The term "Group 4 metals" as used herein refers to the elements in Group 4 of the periodic table of elements which includes Ti, Zr, and Hf. The term "Group 13 metals" as used herein refers to the elements in Group 13 of the periodic table of elements which includes B, Al, Ga, In, and Tl. The term "metal compound" or "metal additive" refers to any compound containing an element of Group 4 and/or Group 13. Various different metal compounds and mixtures thereof can be used in the processes of the present invention, but throughout this description it is to be understood that "metal compounds" or "metal additives" may encompass a single metal compound as well as a mixture of two or more metal compounds.

Examples of inorganic compounds that can be used in the present invention include halides, hydroxides, sulfates, hydrides, hydrates, phosphates, and oxides of the Group 4 and/or Group 13 metals. Other examples of inorganic compounds that can be used include alpha alumina monohydrate, gamma-alumina, and $SnF_2$. In addition, complexes such as $BH_3$ $N(CH_3)_3$ can also be useful in the present invention. Preferably, the inorganic compounds comprise aluminum.

In preferred embodiments, the organometallic compounds are oil soluble or miscible, and in particular, feedstock soluble or miscible compounds. Preferred organometallic compounds which can be employed in the present invention include compounds or mixtures of compounds having the formula:

$$(R^1—O)_n—M—(R^2)_m$$

wherein M is selected from the group consisting of Group 4 and Group 13 metals;

$R^1$ and $R^2$, independently, are alkyl, alkenyl, alkynyl, or aryl;

n is from 0 to 4;

m is from 0 to 4; and the sum of m and n is less than or equal to 4.

"Alkyl" refers to linear, branched or cyclic hydrocarbon groups having from about 1 to about 30 carbon atoms, more preferably from about 1 to about 10 carbon atoms.

"Alkenyl" is an alkyl group containing a carbon-carbon double bond having from about 2 to about 15 carbon atoms, more preferably from about 2 to about 10 carbon atoms.

"Alkynyl" is an alkyl group containing a carbon-carbon triple bond having from about 2 to about 16 carbon atoms, more preferably from about 2 to about 10 carbon atoms.

"Aryl" is an aromatic group containing about 6 to about 18 carbon atoms, more preferably from about 6 to about 14 carbon atoms.

Each alkyl, alkenyl, alkynyl, and aryl group can be optionally substituted with one or more of alkyl, alkenyl, alkynyl, and aryl. In addition, the alkyl, alkenyl, alkynyl, and aryl groups can be optionally substituted with other organic and/or inorganic substituents. Examples of other substituent groups include halo, nitro, esters, phosphates, sulfones, ethers, carboxyllic acids, amines, ketones, aldehydes, and amines. The organic moiety is generally present to aid in the solubility of the compound in the coker feedstock. In preferred embodiments, the organometallic compounds comprise aluminum compounds and are oil soluble, and in particular, feedstock soluble compounds. Examples of preferred aluminum compounds comprise aluminum(isopropoxide)$_3$, aluminum(sec-butoxide)$_3$, aluminum(tert-butoxide)$_3$, aluminum methoxide, aluminum ethoxide, triisobutylaluminum, or mixtures thereof.

Other Group 4 and/or Group 13 metal compounds or mixtures thereof may also be equally effective in the present invention. The inorganic and organometallic compounds are not limited to those described herein. Changing substituents on the metal center will alter several different chemical properties of the inorganic or organometallic material such as the melting and boiling points, the solubility in coker feeds, and the chemical reactivity. Choice of which metal compounds to employ for passivation will depend upon both processing and cost considerations.

The amount of the metal compound that should be added to the coker feedstock will depend on the level of impurities in the coker feedstock and the grade of coke desired as a final product. Typically, the metal compounds can be added in an amount up to about 5 wt % calculated as metal, based on the weight of the feedstock. Generally, the metal compounds can be added to the coker feedstock in an amount of from about 0.001 to about 1 wt % calculated as metal, based on the weight of the coker feedstock. A more preferred range is from about 0.01 to about 0.6 wt % calculated as metal, based on the weight of the feedstock. Aluminum compounds are preferably added in an amount of from about 0.01 to about 0.08 wt % calculated as aluminum, based on the weight of the feedstock.

The metal compounds can be added to the coker feedstock in various forms prior to the completion of the coking process. For example, the metal compounds may be added to the petroleum feedstock in the form of a solid, liquid, solution, or suspension. The solution or suspension is typically made in a liquid medium compatible with the feedstock, such as in a fraction of the feedstock itself or in a light hydrocarbon or alcohol.

The coker feedstock is coked in the presence of the metal additives. The metal additives can be blended with the coker feedstock at some point prior to injection into the coke drum or co-fed separately with the feedstock into the coke drum. The co-feeding may be accomplished through the use of a separate line directed into the coke drum. Preferably, the metal additives are blended with the coker feedstock prior to injection into the coke drum, the blending being accomplished by any conventional method. By blending the metal compounds within the coker feedstock, the methods of the present invention result in a coke product wherein the Group 4 and/or Group 13 metals are distributed generally homogeneously throughout the coke. Accordingly, the present methods provide greater protection from oxidation than prior art methods that practice coating or surface treatments of the coke product (e.g. U.S. Pat. No. 5,628,878). The precise distribution of the Group 4 and/or Group 13 metals in the coke generally depends on the distribution of the metal compounds in the coker feedstock.

The coking process of the present invention is a well known process and can be generally described as thermal cracking. It is preferred to operate the coking process to produce "sponge coke" for the fabrication of carbon anodes used in the Hall-Heroult cell. Sponge coke is well known in the art and can generally be described as a lumpy, homogenous, porous carbonaceous material.

The present invention also relates to a coke composition produced from the methods of the present invention. The coke composition comprises a Group 4 and/or Group 13 metal distributed generally homogeneously throughout the coke in an amount sufficient to passivate the oxidizing tendencies of the metal impurities present in the petroleum coke. The additive metals can be present in an amount of from about 0.003 to about 3 wt % calculated as metal, based on the weight of the coke. Typically, the additive metals are present in an amount greater than 0.02 wt % calculated as metal, based on the weight of the coke. Generally, the metals are present in the coke in an amount of from about 0.02 to about 0.6 wt % calculated as metal, based on the weight of the coke. A more preferred range is from about 0.02 to about 0.3 wt % calculated as metal, based on the weight of the coke. Preferably, the additive metals comprise aluminum. In preferred embodiments, the coke composition of the present invention can be produced by coking a hydrocarbon feedstock in the presence of inorganic and/or organometallic compounds of the Group 4 and/or Group 13 metals in amounts sufficient to passivate the oxidizing tendencies of the metal impurities inherent in the petroleum coke.

The Group 4 and/or Group 13 metal content of the coke composition may be measured by any conventional method including atomic absorption and X-ray fluorescence. The passivating effect of the metal may be measured by an air reactivity test such as the one described in the example below.

Beyond the formation of the inventive coke of the present invention, the invention further relates to the anodes that can be created from that coke. Carbon anode fabrication for use in the Hall-Heroult aluminum production process is well known to those skilled in the art. In one process, green coke (the petroleum coke produced from the coking process) is calcined in a rotary kiln at temperatures between 1200-C and 1400-C resulting in the removal of excess water and volatile matter and in the enhancement of the crystallinity of the coke product. The coke is then sized to desired particle sizes. The anode is typically formed from a blend of binder pitch, a proportion of carbon material recovered from spent carbon anodes, and calcined coke, prebaked at a temperature of about 980–1100-C and compacted to form a monolithic block of amorphous carbon. Another process involves fabrication of Soderberg type anodes, also well known in the art, such anodes being formed continuously and baked in place (as opposed to prebaked) above the electrolytic cell.

EXAMPLE

The general procedure described here was followed to test the effects of introducing chemical additives to petroleum coke in an attempt to reduce the severity of airburn. To 200 g of Oriente/Mesa (60/40) coker feed stock (containing 260 ppm vanadium) was added an inorganic (or organometallic) metal compound. The final concentration of the metal compound in the coker feedstock was 0.1–2.00 wt %. Approximately 25–30 grams of coker feedstock containing the metal compound was then thoroughly mixed and coked in an Alcor MCRT-130 following ASTM process D4530–93 (The Conradson Carbon Residue value for this particular coker feedstock was 26.3%). The resulting coke product (3–5 grams) was calcined at 1000-C for 5 minutes under nitrogen following a temperature ramp from room temperature (ramp rate=20-C/min). The calcined coke was ground to less than or equal to 75_m size particles (200 Tyler mesh). Using a TA Instruments model SDT 2960 thermogravimetric analyzer (TGA), the ground coke particles (approximately 25–30 mg) were then examined for their air reactivity. The air reactivity measurements were performed at 490-C in an air environment using ceramic baskets as sample holders. Table 1 shows the relative air reactivities over a 30 minute time interval (the rate of carbon loss was measured over the time period 21–51 minutes after the sample had reached 490-C).

As shown in Table 1, the metal compounds employing Group 4 and Group 13 metals were effective in diminishing air reactivity of the coke. The feedstock soluble metal additives, namely the organometallic compounds, were particularly effective.

TABLE 1

Relative Air Reactivities of an Oriente/Mesa (60/40) Coke Containing Various Chemical Additives.

| Additive (Percentage in Coker Feed) | Wt. Percentage of Metal in the Coker Feed | Relative Air Reactivity[1] |
|---|---|---|
| Base Coke (0%) | 0% | 100 |
| $YF_3$ (1.0%) | 0.61% | 140 |
| $CeO_2$ (0.37%) | 0.30% | 136 |
| $Bi_2O_3$ (0.52%) | 0.47% | 121 |
| $La_2O_3$ (0.37%) | 0.32% | 100 |
| $FeF_3$ (1.0%) | 0.70% | 94 |
| $TiF_4$ (1.0%) | 0.39% | 93 |
| MgO (1.99%) | 1.20% | 71 |
| $AlF_3$ (1.50%) | 0.48% | 71 |
| $SrCO_3$ (0.48%) | 0.29% | 64 |
| $Al_2(SO_4)_3$ (1%) | 0.16% | 61 |
| $Al(OH)_3 \times H_2O$ (1.73%) | 0.60% | 57 |
| Gamma-alumina (2.0%) | 1.06% | 55 |
| $Sb_2O_3$ (0.52%) | 0.43% | 53 |
| $ZrF_4$ (1.0%) | 0.55% | 51 |
| $InF_3$ (1.0%) | 0.67% | 39 |
| $SnF_2$ (1.0%) | 0.83% | 37 |
| $GaF_3$ (1.0%) | 0.71% | 33 |

TABLE 1-continued

Relative Air Reactivities of an Oriente/Mesa (60/40) Coke Containing Various Chemical Additives.

| Additive (Percentage in Coker Feed) | Wt. Percentage of Metal in the Coker Feed | Relative Air Reactivity[1] |
|---|---|---|
| $In(OH)_3$ (1.0%) | 0.69% | 27 |
| $Al(iso\text{-}propoxide)_3$(1.48%) | 0.20% | 21 |
| $B_2O_3$ (0.57%) | 0.18% | 21 |
| $Al(tert\text{-}butoxide)_3$ (1.51%) | 0.17% | 21 |
| $Al(sec\text{-}butoxide)_3$ (1.46%) | 0.16% | 21 |
| $Ga_2O_3$ (1.0%) | 0.74% | 20 |
| $Ti(iso\text{-}propoxide)_4$ (1.0%) | 0.17% | 18 |
| Triisobutylaluminum (1.25%) | 0.17% | 11 |
| $BH_3.N(CH_3)_3$ (1.0%) | 0.15% | 11 |

[1]The base coke (no additive) is arbitrarily assigned a relative reactivity value of 100. Values <100 indicate materials possessing diminished air reactivities relative to the base coke.

It is evident from the data that inorganic compounds and organometallic compounds of the Group 4 and Group 13 metals added to a coker feedstock effectively passivate the catalytic effects of metal impurities, such as vanadium, in the resulting coke product. Oxide and organic-containing additives were particularly effective.

Although the invention has been described in detail and with reference to specific embodiments thereof, it will be apparent to one skilled in the art that various changes and modifications can be made therein without departing from the scope and spirit of the present invention.

What is claimed is:

1. A petroleum coke composition containing metal impurities, wherein the petroleum coke comprises a Group 4 or Group 13 metal, or mixtures thereof, homogeneously distributed throughout the coke in an amount sufficient to passivate the oxidizing tendencies of the metal impurities in the petroleum coke.

2. The composition of claim 1 wherein the coke comprises from about 0.003 to about 3 wt % of the Group 4 and Group 13 metal, based on the weight of the coke.

3. The composition of claim 1 wherein the Group 4 or Group 13 metal comprises aluminum.

4. A carbon anode suitable for use in aluminum manufacture and formed from the petroleum coke composition of claim 1.

5. The carbon anode of claim 4, wherein the coke comprises from about 0.003 to about 3 wt % of the Group 4 and Group 13 metal, based on the weight of the coke.

6. The carbon anode of claim 4, wherein the Group 4 or Group 13 metal comprises aluminum.

* * * * *